US009074393B2

(12) United States Patent
Brose et al.

(10) Patent No.: US 9,074,393 B2
(45) Date of Patent: Jul. 7, 2015

(54) MOTOR VEHICLE LOCK

(75) Inventors: Simon Brose, Hattingen (DE); Jürgen Zietlow, Wuppertal (DE)

(73) Assignee: BROSE SCHLIESSSYSTEME GMBH & CO. KG, Wuppertal (DE)

( * ) Notice: Subject to any disclaimer, the term of this patent is extended or adjusted under 35 U.S.C. 154(b) by 860 days.

(21) Appl. No.: 13/119,924

(22) PCT Filed: Sep. 21, 2009

(86) PCT No.: PCT/EP2009/006792
§ 371 (c)(1),
(2), (4) Date: Jun. 28, 2011

(87) PCT Pub. No.: WO2010/031580
PCT Pub. Date: Mar. 25, 2010

(65) Prior Publication Data

US 2011/0259061 A1 Oct. 27, 2011

(30) Foreign Application Priority Data

Sep. 21, 2008 (DE) ..... 20 2008 012 484 U

(51) Int. Cl.
*E05C 3/06* (2006.01)
*E05B 77/26* (2014.01)
(Continued)

(52) U.S. Cl.
CPC ..... *E05B 77/26* (2013.01); *E05B 81/06* (2013.01); *E05B 81/62* (2013.01); *E05B 77/28* (2013.01); *E05B 81/16* (2013.01); *E05B 81/42* (2013.01)

(58) Field of Classification Search
USPC ..... 292/201, 216, DIG. 23
See application file for complete search history.

(56) References Cited

U.S. PATENT DOCUMENTS 924,081 A * 6/1909 Loev ..... 292/263
1,769,489 A 7/1930 Hermenegilde
(Continued)

FOREIGN PATENT DOCUMENTS

DE 19505779 8/1996
DE 19819603 11/1999
(Continued)

OTHER PUBLICATIONS

German Search Report, dated Oct. 28, 2009, in corresponding DE 20 2008 012 484.0, related to this U.S. Appl. No. 13/119,924, 4 pages.
(Continued)

*Primary Examiner* — Carlos Lugo
(74) *Attorney, Agent, or Firm* — Pauly, DeVries Smith & Deffner, LLC

(57) ABSTRACT

A motor vehicle lock having the locking elements lock catch and pawl (1) and having a lock mechanism (2), it being possible for the lock mechanism (2) to be moved into different functional states such as "unlocked", "locked", "anti-theft locked" or "child-safety locked" and with the lock mechanism (2), for this purpose, having at least one functional element (3) which can be adjusted into corresponding functional positions. The invention proposes mounting the functional element (3) in a subregion, in particular an end region, of the functional element (3) with a bearing arrangement (3*a*) such that the rest of the functional element (3) can be adjusted both in the lateral direction and in the vertical direction, in each case substantially perpendicular to its longitudinal extent, in relation to a reference plane (R) in any case.

26 Claims, 12 Drawing Sheets

Figure 1:
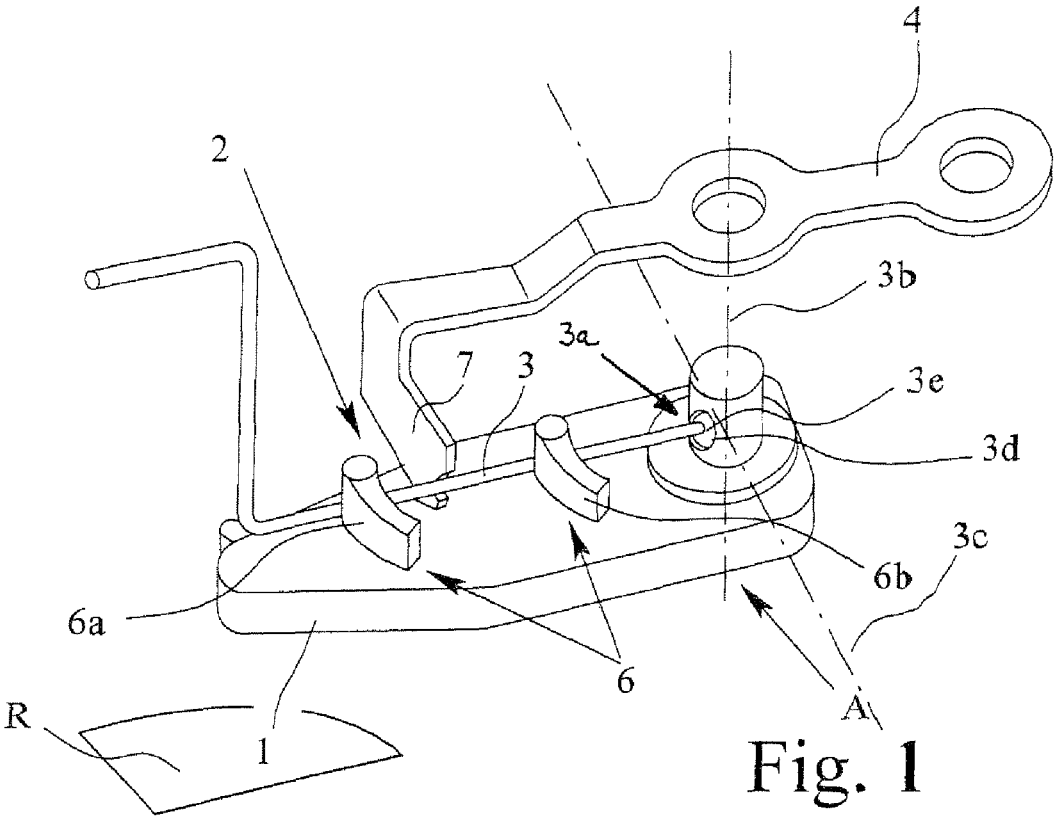

(51) Int. Cl.

| | |
|---|---|
| ***E05B 81/06*** | (2014.01) |
| ***E05B 77/28*** | (2014.01) |
| ***E05B 81/16*** | (2014.01) |
| ***E05B 81/42*** | (2014.01) |
| *E05C 3/00* | (2006.01) |
| *E05B 81/62* | (2014.01) |

(56) References Cited

U.S. PATENT DOCUMENTS

| | | | | | |
|---|---|---|---|---|---|
| 3,584,907 | A | | 6/1971 | Mertes | |
| 4,441,345 | A | | 4/1984 | Guarr | |
| 4,455,042 | A | | 6/1984 | Yamada | |
| 4,601,500 | A | | 7/1986 | Bernard | |
| 4,762,351 | A | * | 8/1988 | Bowman | 292/263 |
| 4,906,035 | A | | 3/1990 | Nagai et al. | |
| 4,941,694 | A | | 7/1990 | Bartel et al. | |
| 5,273,326 | A | * | 12/1993 | Kinkaide | 292/272 |
| 5,366,316 | A | * | 11/1994 | Cymbal | 403/378 |
| 5,549,337 | A | | 8/1996 | Mcculloch | |
| 5,618,070 | A | | 4/1997 | Tunis et al. | |
| 5,813,709 | A | * | 9/1998 | Umino | 292/216 |
| 5,938,253 | A | | 8/1999 | Szablewski et al. | |
| 5,967,572 | A | * | 10/1999 | Sajfert et al. | 292/336.3 |
| 6,511,107 | B2 | * | 1/2003 | Barczynski et al. | 292/216 |
| 6,519,986 | B2 | * | 2/2003 | Wicker | 70/237 |
| 6,536,814 | B2 | * | 3/2003 | Kachouh | 292/216 |
| 6,592,157 | B1 | * | 7/2003 | Spurr | 292/216 |
| 6,805,386 | B2 | * | 10/2004 | Ehret et al. | 292/216 |
| 7,175,211 | B2 | * | 2/2007 | Cetnar et al. | 292/216 |
| 7,261,333 | B2 | * | 8/2007 | Tomaszewski | 292/201 |
| 7,261,338 | B2 | * | 8/2007 | Spurr | 292/216 |
| 7,311,340 | B2 | * | 12/2007 | Baillet | 292/216 |
| 7,371,180 | B2 | * | 5/2008 | Cymbal et al. | 464/119 |
| 7,543,861 | B2 | * | 6/2009 | Dupont et al. | 292/216 |
| 7,568,740 | B2 | | 8/2009 | Brose et al. | |
| 8,528,950 | B2 | * | 9/2013 | Organek et al. | 292/216 |
| 8,727,398 | B2 | | 5/2014 | Brose et al. | |
| 2002/0063430 | A1 | | 5/2002 | Amano | |
| 2003/0094818 | A1 | | 5/2003 | Tomaszewski et al. | |
| 2005/0006908 | A1 | | 1/2005 | Bruwer et al. | |
| 2006/0103145 | A1 | | 5/2006 | Ottolini et al. | |
| 2006/0267351 | A1 | | 11/2006 | Spurr | |
| 2007/0173336 | A1 | * | 7/2007 | Cymbal et al. | 464/119 |
| 2009/0129855 | A1 | * | 5/2009 | Brisset et al. | 403/163 |
| 2011/0084505 | A1 | | 4/2011 | Brose | |
| 2011/0108052 | A1 | | 5/2011 | Morgandi et al. | |
| 2011/0181052 | A1 | | 7/2011 | Brose et al. | |
| 2011/0210564 | A1 | | 9/2011 | Sun et al. | |
| 2011/0252844 | A1 | | 10/2011 | Shoemaker | |
| 2012/0068480 | A1 | | 3/2012 | Bendel et al. | |

FOREIGN PATENT DOCUMENTS

| | | | | |
|---|---|---|---|---|
| DE | 19841670 | | 3/2000 | |
| DE | 10350325 | | 5/2004 | |
| DE | 10258645 | | 7/2004 | |
| DE | 102004017014 | | 10/2005 | |
| DE | 102004042444 | | 3/2006 | |
| DE | 102008018500 | * | 4/2009 | E05B 65/12 |
| EP | 0153234 | | 2/1985 | |
| EP | 1845224 | | 10/2007 | |
| EP | 2199502 | * | 6/2010 | |
| JP | 51041819 | | 4/1976 | |
| JP | 2-27079 | | 2/1996 | |
| JP | 2-27080 | | 2/1996 | |
| WO | 96/26341 | | 8/1996 | |
| WO | 98/28508 | | 7/1998 | |

OTHER PUBLICATIONS

PCT International Search Report, dated Dec. 28, 2009, in corresponding PCTEP2009/006792, related to this U.S. Appl. No. 13/119,924, 9 pages.

DE Search Report, for German App. No. 202007013330.8, search completed Apr. 29, 2008 (4 pages).

"International Search Report", for PCT Application No. PCT/EP2008/007960, mailed Feb. 6, 2009 (6 pages).

"Non-Final Office Action", from U.S. Appl. No. 12/679,201, mailed May 24, 2013, 8 pages.

"Notice of Allowance", for U.S. Appl. No. 12/679,201, mailed Nov. 29, 2013 (11 pages).

"Response to Non-Final Office Action", for U.S. Appl. No. 12/679,201, filed Sep. 24, 2013 (9 pages).

* cited by examiner

MOTOR VEHICLE LOCK

The invention relates to a motor vehicle lock used in all types of closure elements of a motor vehicle. These include, in particular, side doors, rear doors, tailgates, trunk lids or engine hoods. Said closure elements can, in principle, also be designed in the manner of sliding doors.

The known motor vehicle lock (DE 102 58 645 B4), on which the invention is based, has a motor vehicle lock having the locking elements lock catch and pawl. The lock catch can be moved, in the usual way, into an open position, into a main locking position and into a preliminary locking position. In this case, the pawl has the task of holding the lock catch in the two locking positions. The pawl has to be manually lifted in order to release the lock catch.

In the known motor vehicle lock, the pawl is manually lifted when mechanical redundancy is realized. This means that the pawl is normally lifted by means of a motor, and is manually lifted only in an emergency, for example in the event of a power failure.

The known motor vehicle lock is also equipped with a lock mechanism which can be switched into different functional states. These functional states are the "unlocked", "locked", "anti-theft locked" and "child-safety locked" functional states. In the "unlocked" functional state, the associated motor vehicle door can be opened by operating the internal door handle and the external door handle. In the "locked" functional state, said door cannot be opened from the outside but can be opened from the inside. In the "anti-theft locked" functional state, said door cannot be opened either from the outside or from the inside. In the "child-safety locked" functional state, said door can be opened from the outside but not from the inside.

It is now usually the case that the external door handle is coupled to an external operating lever and the internal door handle is coupled to an internal operating lever, with the two operating levers being coupled to or decoupled from the pawl depending on the functional state. For this purpose, the lock mechanism is equipped with a coupling arrangement in which a coupling pin which is displaceable in one plane interacts with different control slots. Realizing the above coupling function in this way is mechanically complex.

The invention is based on the problem of designing and developing the known motor vehicle lock in such a way that the structural design is simplified.

In the case of a motor vehicle lock having the features described herein the above problem is solved.

What is essential is the idea that the functional element which is critical for realizing the different functional states of the lock mechanism can be adjusted both in the lateral direction and in the vertical direction, in each case substantially perpendicular to its longitudinal extent, in relation to a reference plane. This ensures that the adjustment range of the functional element is not restricted to a single plane, this incidentally allowing a particularly simple refinement of the lock mechanism.

In order to implement the above, extended adjustment range of the functional element, a bearing arrangement, which is preferably positioned in an end region of the functional element, is associated with the functional element.

In the preferred refinement, the bearing arrangement of the functional element comprises a ball socket and a ball which engages with the ball socket. The adjustment range, which is discussed above, of the functional element can be realized in a structurally particularly simple manner in this way.

In the a further preferred refinement, the vertical adjustment of the functional element serves to adjust the lock mechanism into the corresponding functional states, for example the functional states "unlocked" and "locked".

Accordingly, in the a further preferred refinement, the functional element for realizing functional states of the lock mechanism provides a switchable coupling, with the functional element acting as such in the coupled state so as to transmit force.

In a particularly preferred refinement, provision is now made, for operation, for example by the external operating lever in the coupled state, which generally corresponds to the lock state "unlocked", to be accompanied by a lateral adjustment of the functional element.

Therefore, the vertical adjustment of the functional element is associated with coupling and decoupling and the lateral adjustment of the functional element is associated with operation in the coupled state. This association leads not only to a simple structural refinement but also to a reduction in the amount of installation space required.

A particularly simple way of realizing the adjustment of the functional element is the invention. In this case, a control drive is provided with a control shaft on which the associated functional element is supported. This can be realized in a structurally simple manner. A further particular advantage is that the control shaft can have a plurality of control sections which are arranged next to one another and are associated with different functional elements.

According to a further teaching which is likewise accorded an independent meaning, the above problem is solved, in the case of a motor vehicle lock, by the features of the invention.

According to this further teaching, what is essential is the idea that the functional element can be designed to be resilient, in particular in the form of a resiliently flexible wire or strip, and, in the process, to ensure the adjustability of the functional element in the vertical direction solely by means of a bearing arrangement and in the lateral direction solely by means of the flexibility of the functional element, or to ensure the adjustability of the functional element in the lateral direction solely by means of a bearing arrangement and in the vertical direction solely by means of the flexibility of the functional element.

Realizing the adjustability of the functional element in this way leads to very particularly simple structural solutions.

Figure 2:
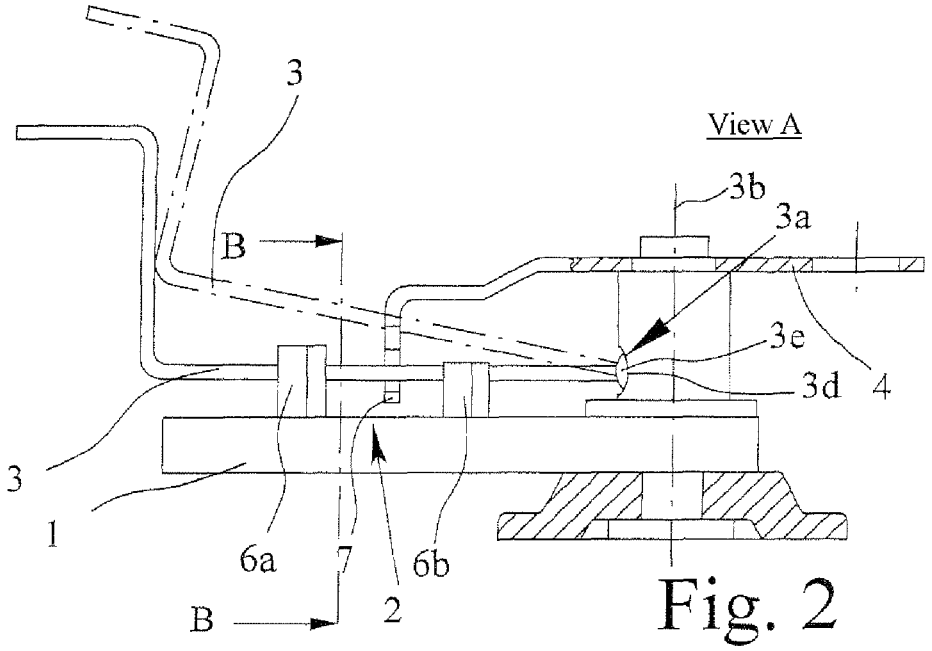
Figure 3:
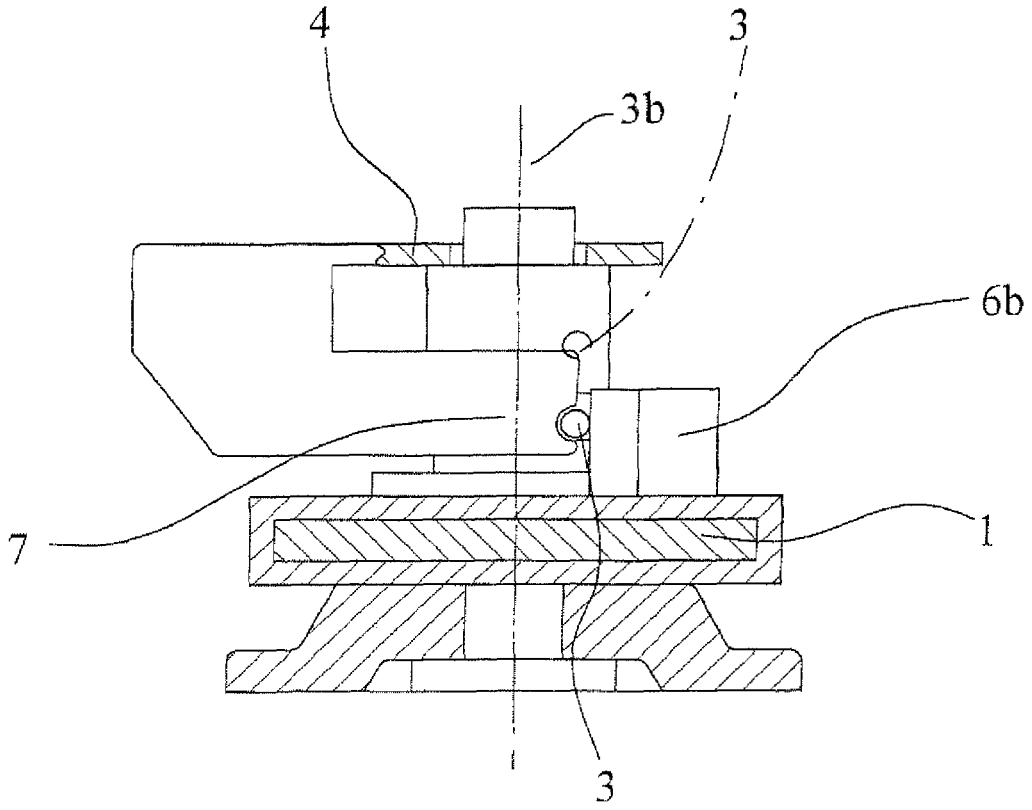
Figure 4:
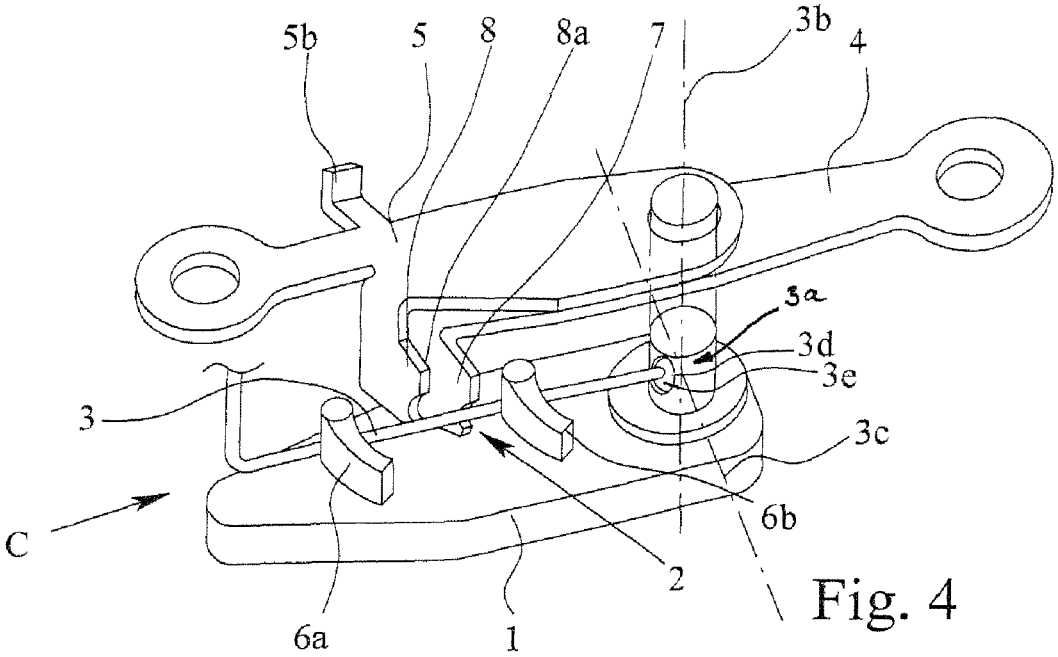
Figure 5:
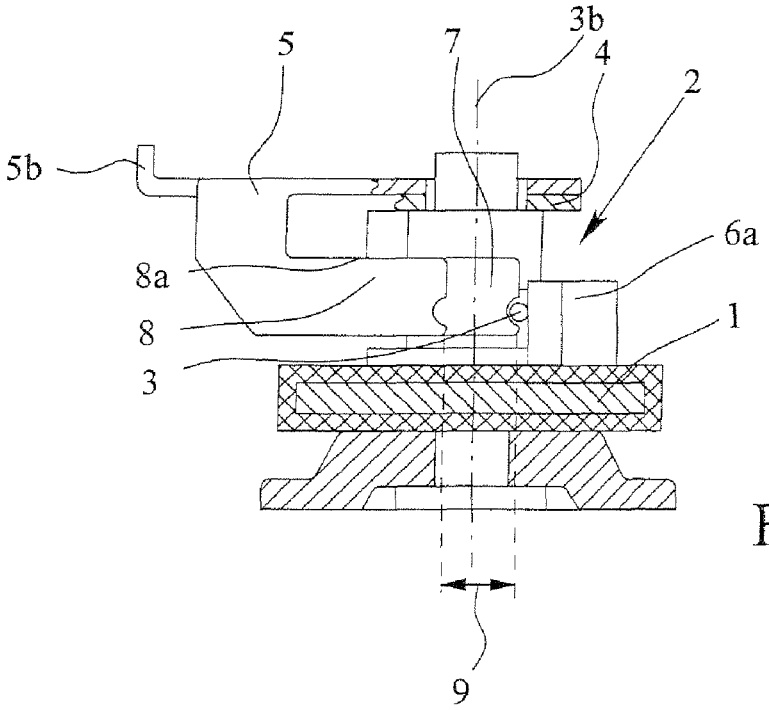
Figure 6:
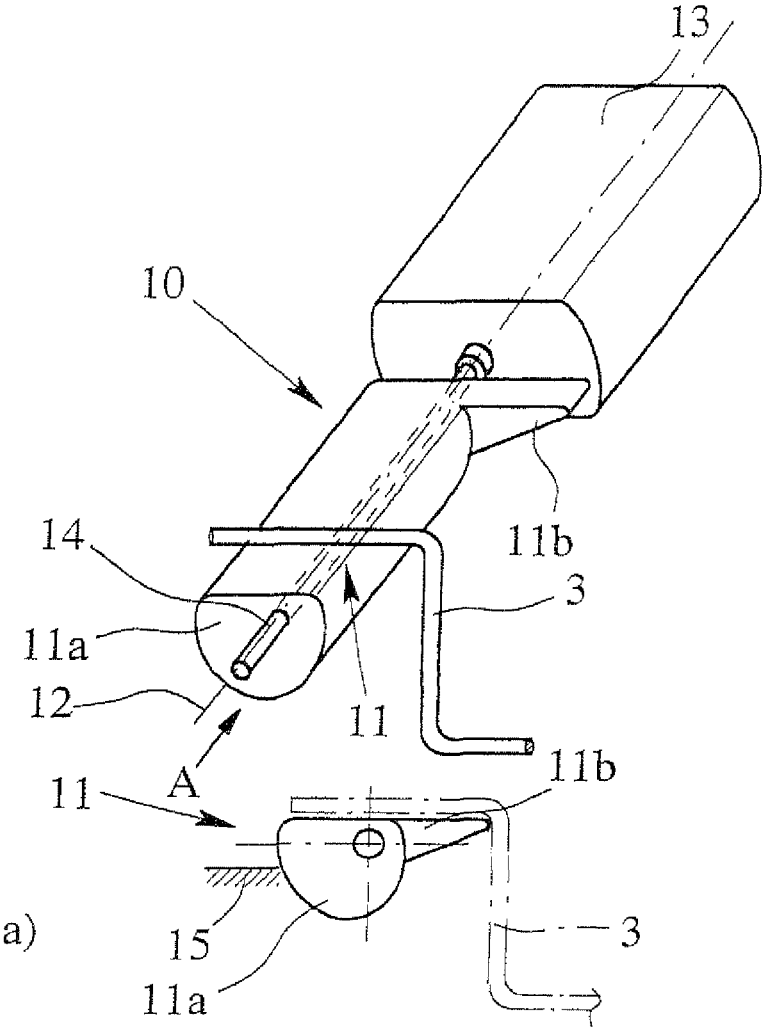
Figure 7:
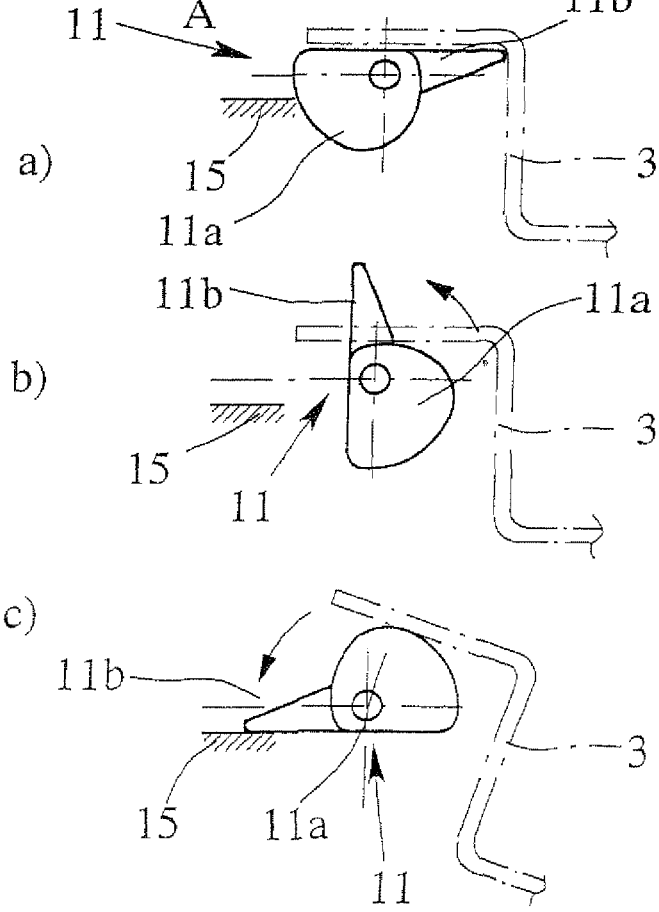
Figure 8:
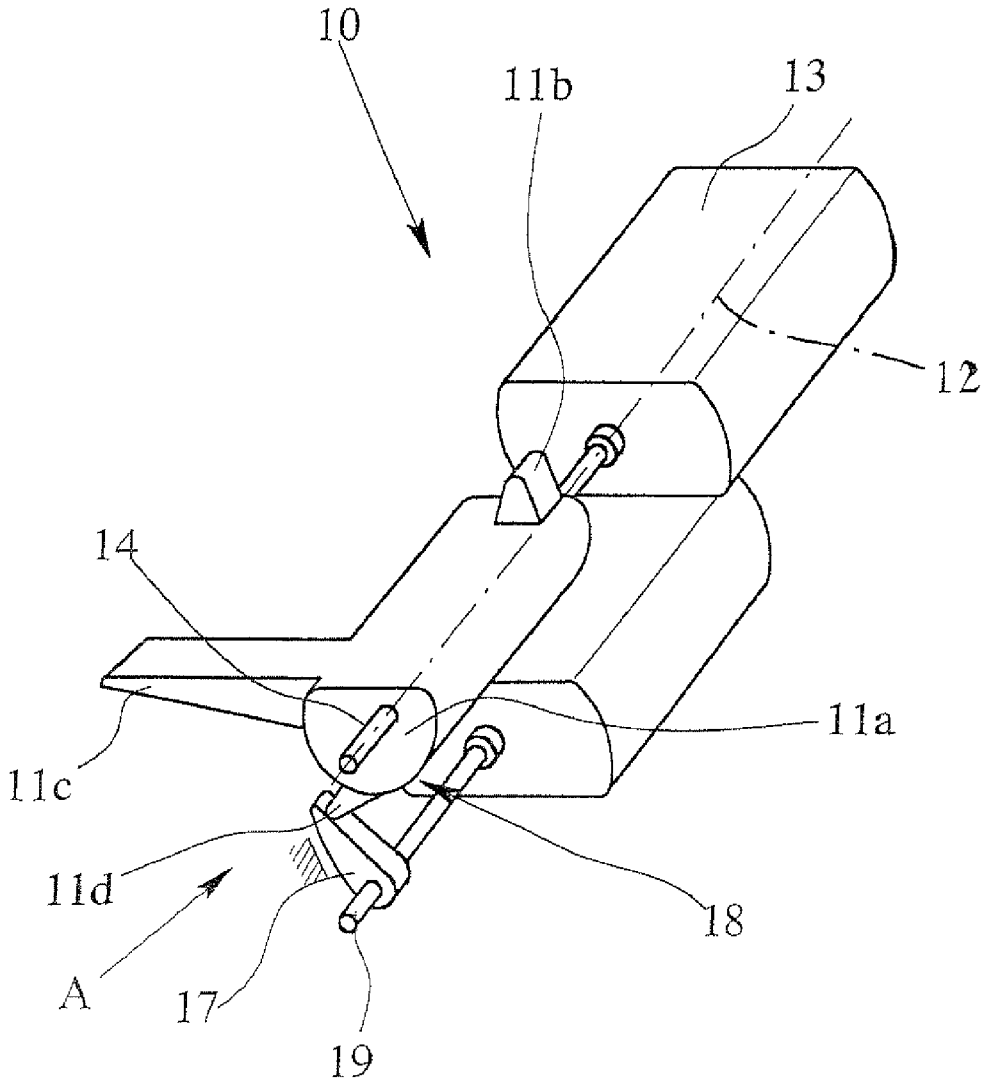
Figure 9:
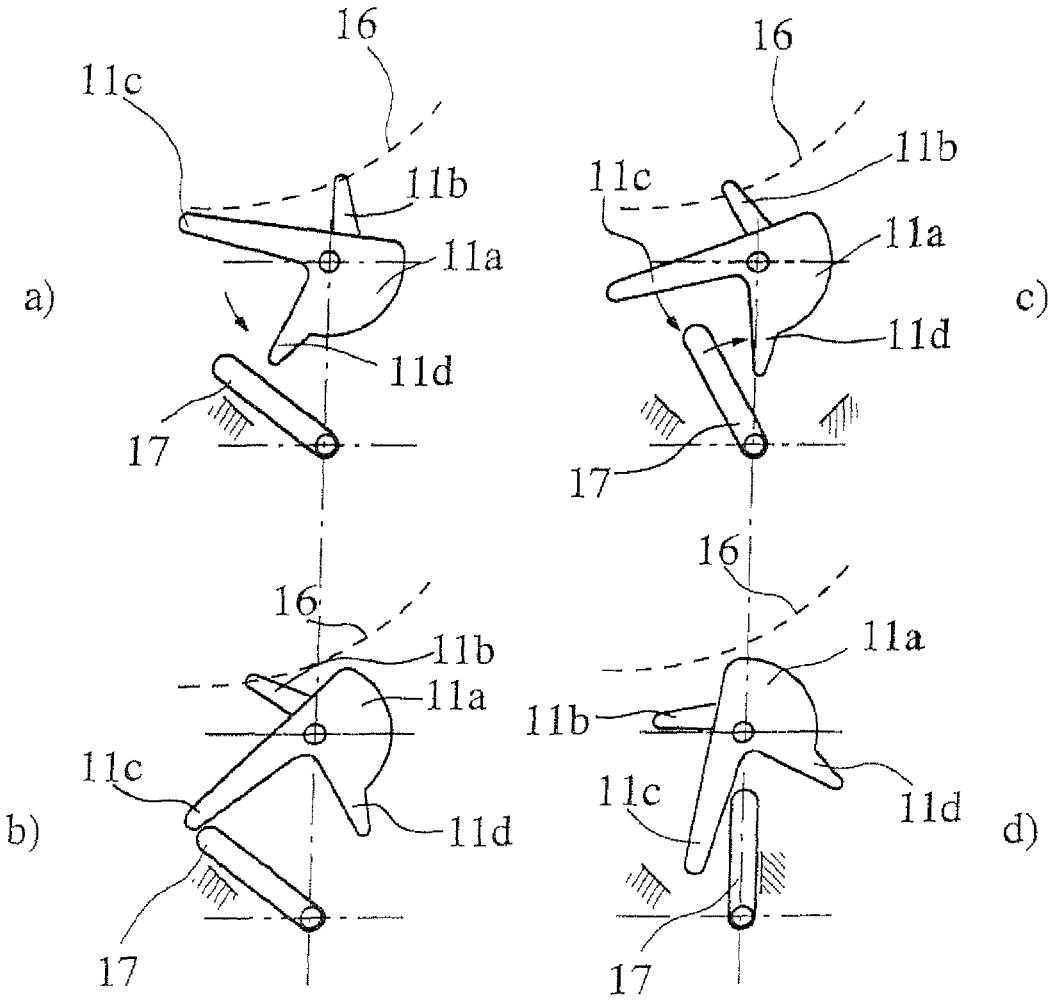
Figure 10:
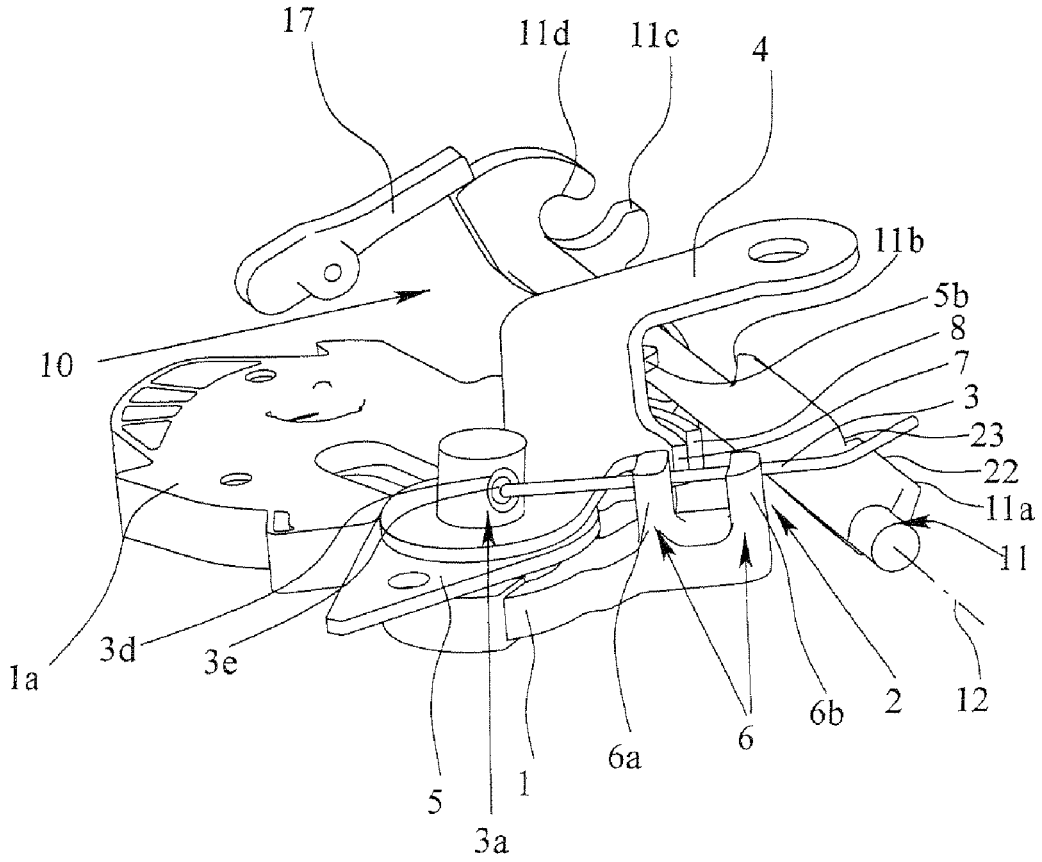
Figure 11:
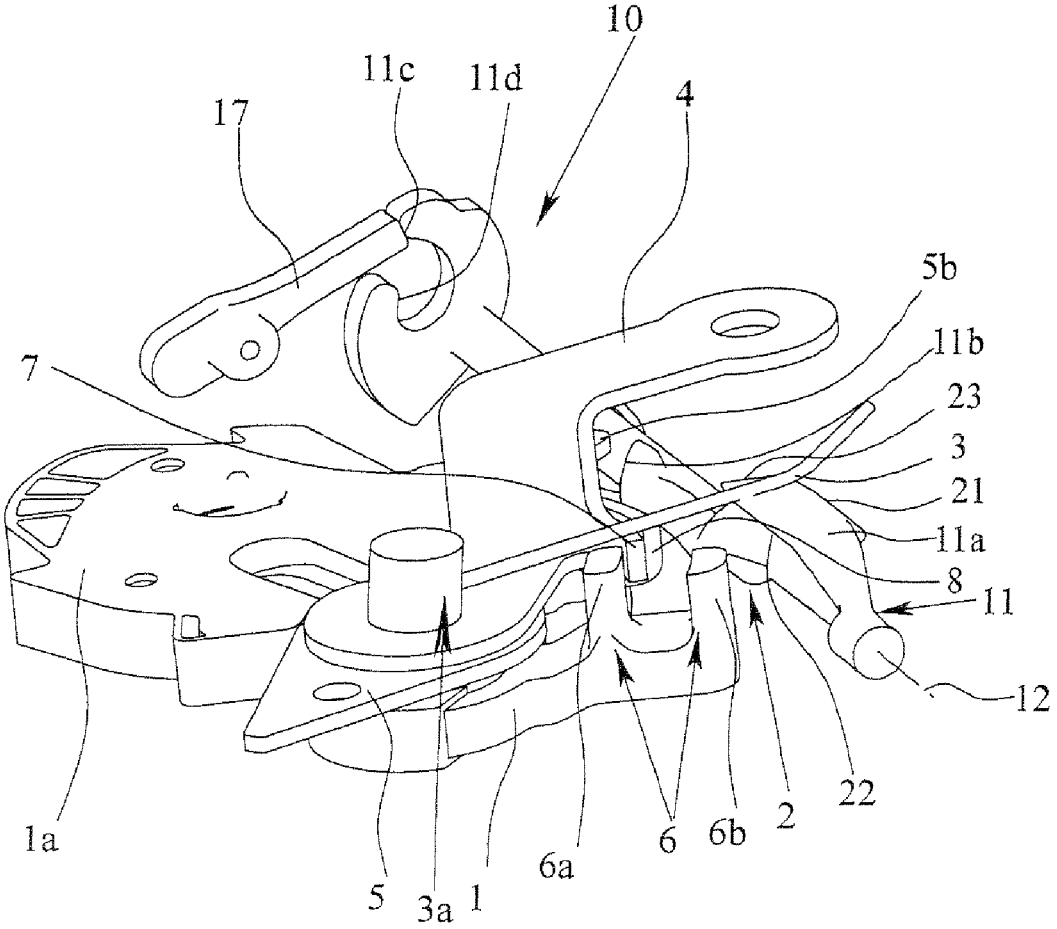
Figure 12:
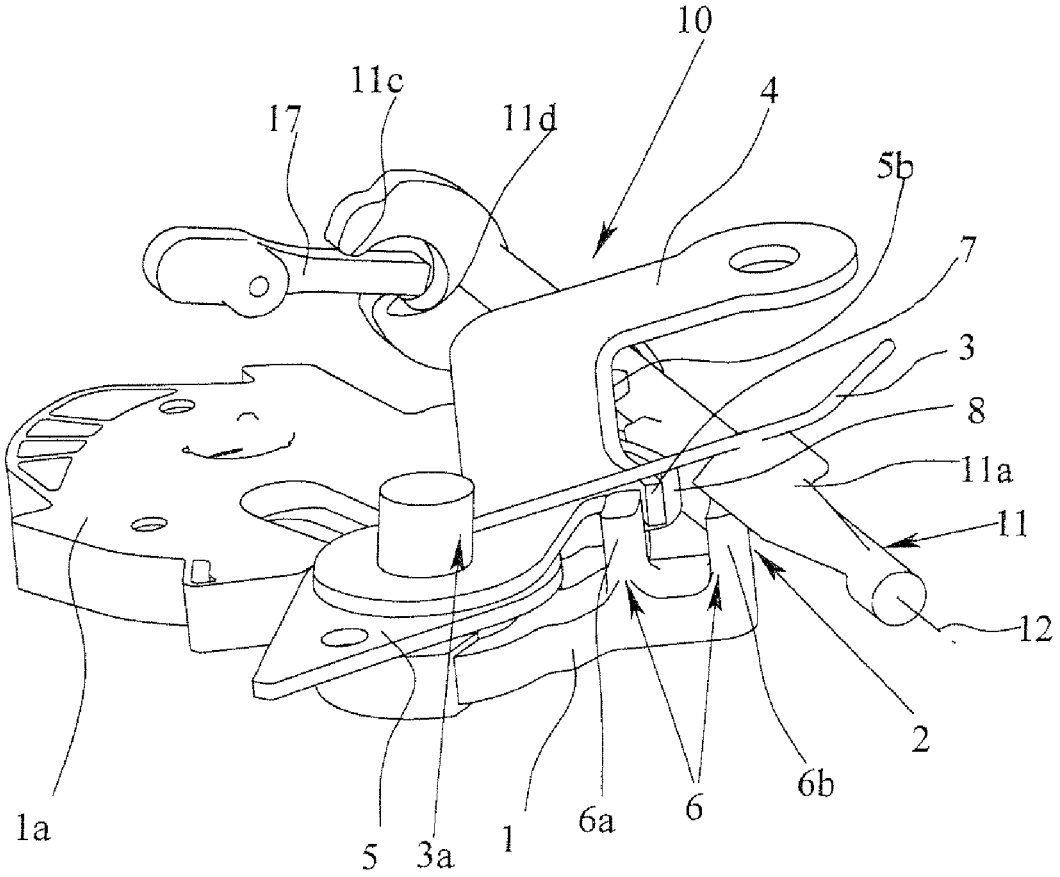
Figure 13:
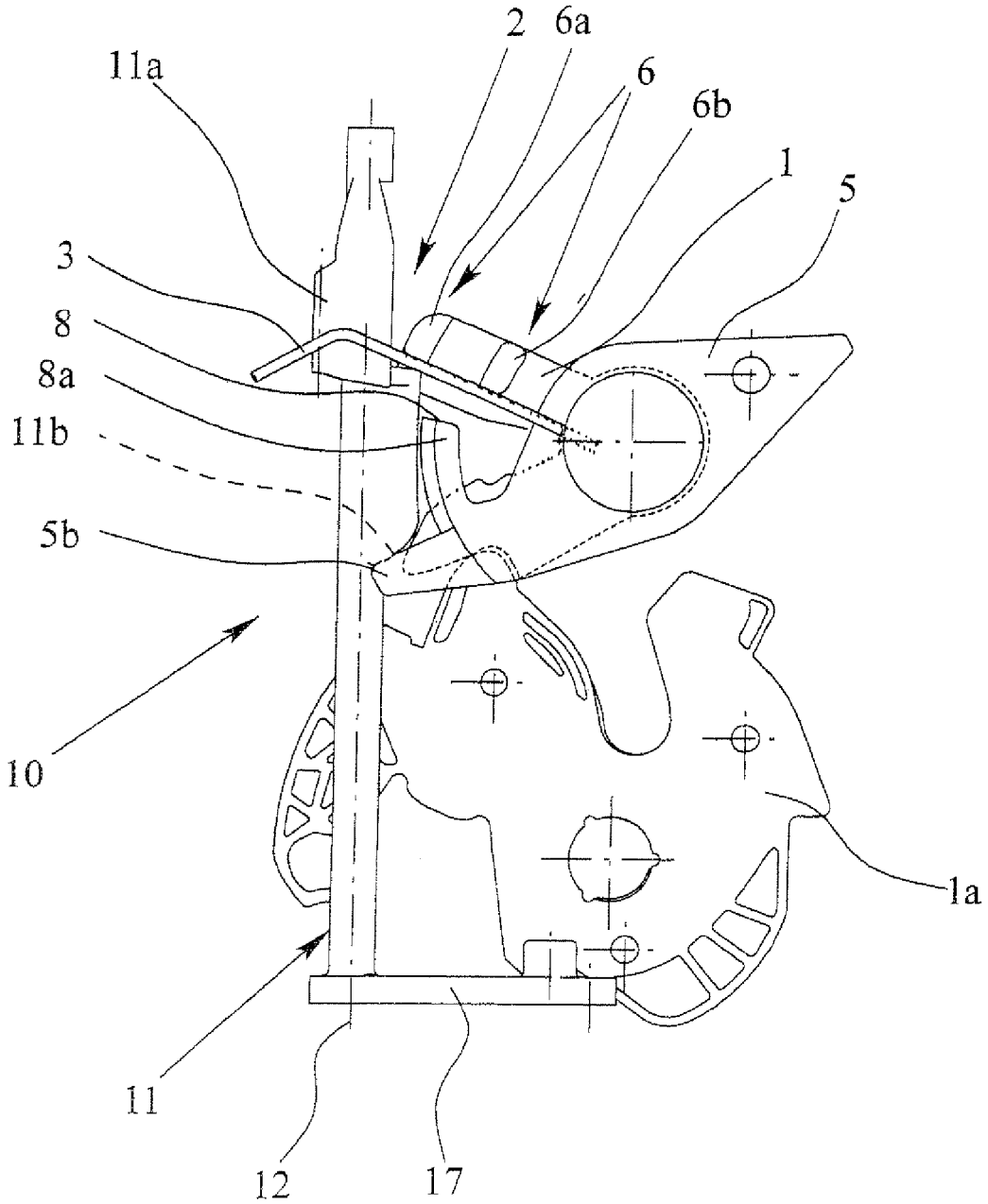
Figure 14:
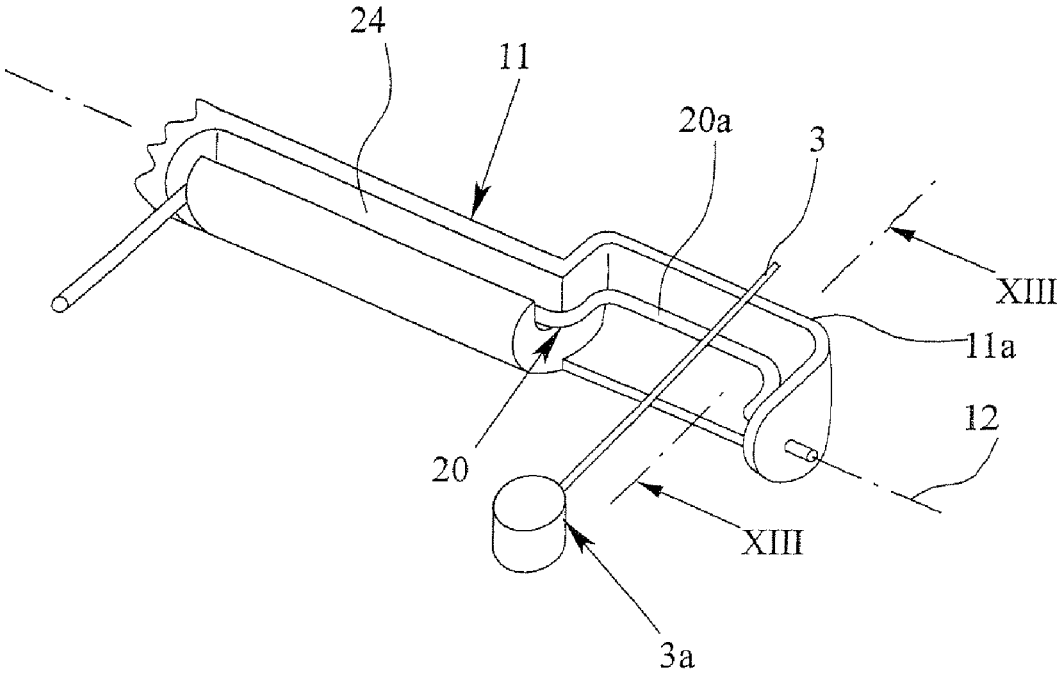
Figure 15:
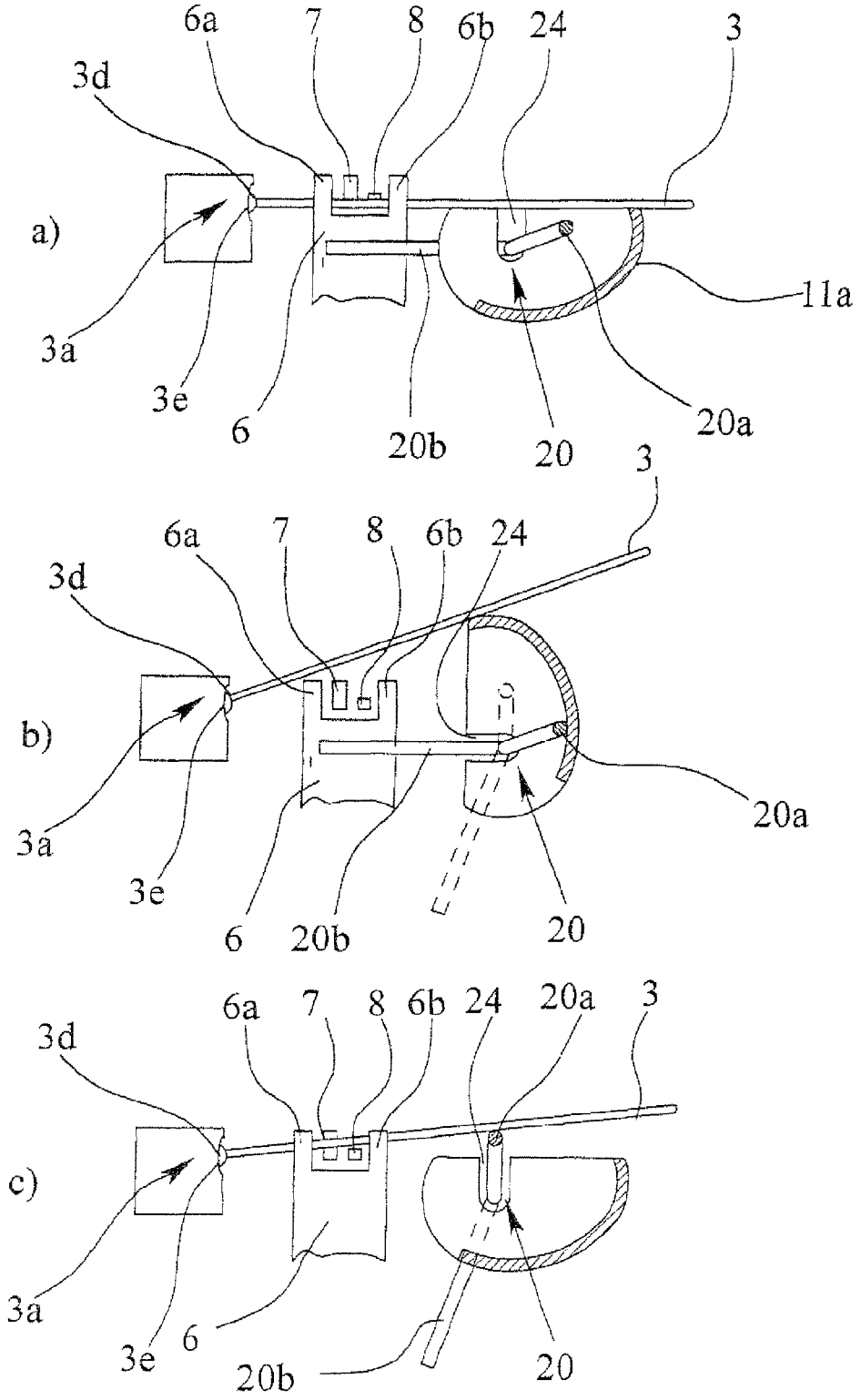

Further details, features, aims and advantages of the present invention are explained in more detail below with reference to preferred exemplary embodiments. In the drawing:

FIG. 1 shows a perspective illustration of a motor vehicle lock according to the proposal with the components which are essential for explaining the invention, FIG. 2 shows the motor vehicle lock according to FIG. 1 in view A, FIG. 3 shows a sectional view of the motor vehicle lock according to FIG. 2 along section line B-B, FIG. 4 shows a further motor vehicle lock according to the proposal in a view according to FIG. 1, FIG. 5 shows the motor vehicle lock according to FIG. 4 in a view according to FIG. 3, FIG. 6 shows a perspective view of a control drive according to the proposal, FIG. 7 shows the control drive according to FIG. 6 in view A in three control positions, FIG. 8 shows a further control drive according to the proposal in a view according to FIG. 6, FIG. 9 shows the control drive according to FIG. 8 in view A in four control positions, FIG. 10 shows a perspective illustration of a further motor vehicle lock according to the proposal having the components which are essential for explaining the invention in the "unlocked" functional state, FIG. 11 shows the motor vehicle lock according to FIG. 10 in the "locked" functional state, FIG. 12 shows the motor vehicle lock according FIG. 10 in the "anti-theft locked" functional state, FIG. 13 shows a plan view of the motor vehicle lock according to FIG. 10, without the external operating lever and the bearing arrangement for the functional element, in the "locked" functional state when the internal operating lever is operated, FIG. 14 shows a perspective illustration of a further motor vehicle lock according to the proposal having selected components, which relate to the control drive, in the "unlocked" functional state, and FIG. 15 shows the motor vehicle lock according to FIG. 14 in a sectional view along section line XIII-XIII in a) the "unlocked" functional state, b) the "locked" ("locked and child-safety locked" illustrated by dashed lines) functional state, and c) the "unlocked and child-safety locked" functional state.

It should first be noted that the drawing illustrates only those components of the motor vehicle lock according to the proposal which are necessary for explaining the teaching. Accordingly, a lock catch which interacts in the usual way with the pawl is not illustrated in FIGS. 1 to 9 and 13, 14, 15.

FIGS. 1 to 3 and 4, 5 show two embodiments of a motor vehicle lock according to the proposal which has the locking elements lock catch and pawl 1. Also provided is a lock mechanism 2 which can be moved into different functional states such as "unlocked", "locked", "anti-theft locked" or "child-safety locked". In general, the lock mechanism 2 ensures that the pawl 1 can be lifted by means of operating the external door handle and/or the internal door handle or cannot be lifted at all, depending on the functional state. In the case of an electric lock, the lock mechanism 2 may also serve merely to couple an emergency operation means to the pawl 1. The term "lock mechanism" is therefore to be understood in a broad sense.

In order to adjust the lock mechanism 2 into the above functional states, it has at least one functional element 3 which can be adjusted into corresponding functional positions. The lock mechanism 2 can therefore be moved into the desired functional states by means of adjusting the functional element 3 or the functional elements.

It is possible, in principle, for a plurality of functional elements 3 to be provided in order to realize the functional states of the lock mechanism 2. However, only a single functional element 3 in the above sense is provided in the text which follows, but this should not be understood as being restrictive.

The functional element 3 is now mounted in a subregion, here and preferably in an end region, of the functional element 3 by means of a bearing arrangement 3*a* such that the rest of the functional element 3 can be adjusted both in the lateral direction and in the vertical direction, in each case substantially perpendicular to its longitudinal extent, in relation to a reference plane R in any case. The introduction of the reference plane R serves merely to define firstly the vertical adjustment and secondly the lateral adjustment in this case. In this context, the vertical adjustment is associated with a change in the distance between the functional element 3 and the reference plane R. In contrast, lateral adjustment of the functional element 3 is adjustment of the functional element 3 substantially parallel to the reference plane R. Vertical and lateral adjustments can be superimposed on one another in this case, this leading to corresponding adjustments in directions which are diagonal in relation to the reference plane R.

The reference plane R can be oriented largely as desired. However, in a particularly preferred refinement, the reference plane R is oriented substantially parallel to a flat face of the motor vehicle lock. Given a corresponding functional association of vertical adjustment and lateral adjustment, this is structurally advantageous, as explained further below. However, in principle, the reference plane can also be oriented substantially perpendicular to a flat face of the motor vehicle lock.

The functional element 3 is preferably a lever-like functional element. This means that the functional element 3 is articulated such that it can pivot in any manner and has a lever arm which then also determines the longitudinal extent of the functional element 3.

Here and preferably, the functional element 3 is prestressed into the starting position which is illustrated in FIG. 1. The prestress preferably leads to the functional element 3 always automatically returning to the starting position. As a result, only one corresponding support means for the functional element 3 is required for adjusting the functional element 3. This will also be explained in more detail further below.

The vertical adjustment and the lateral adjustment of the functional element 3 are preferably in each case attributed to a pivoting movement of the functional element 3. However, in principle, provision may also be made for either the vertical adjustment or the lateral adjustment of the functional element 3 to be attributed to a pivoting movement of the functional element 3. Each pivoting movement has an associated geometric pivot axis 3*b*, 3*c*, these pivot axes each running in an end region of the functional element 3.

Numerous options are feasible for designing the bearing arrangement 3*a*.

For example, provision may be made for the bearing arrangement 3*a* to have an elastic bearing element which is firstly fixed to the lock housing or the like or connected to the lock housing or the like or integrally formed on the lock housing or the like, and secondly is connected to the functional element 3.

It is also feasible for the bearing arrangement 3*a* to have an elastic, possibly rubber-like, region in which the functional element 3 is inserted.

However, the bearing arrangement 3*a* preferably has two bearing elements which engage with one another in a bearing manner. In this case, one bearing element is preferably fixed and the other bearing element is coupled or connected to the functional element 3. In particular, provision is made for friction or sliding friction to prevail between the two bearing elements when the functional element 3 is adjusted.

In a particularly preferred refinement, the bearing arrangement 3*a* is at least partly designed in the manner of a sliding bearing. This covers all refinements which have parts which accordingly slide one on the other in the event of a vertical and/or lateral adjustment. The bearing arrangement 3*a* is preferably designed in the form of a pure sliding bearing.

In a particularly preferred refinement, the bearing arrangement 3*a* of the functional element 3 is equipped with a first pivot bearing for the vertical adjustment and with a second pivot bearing for the lateral adjustment, with the two pivot bearings preferably being located in an end region of the functional element 3. A particularly compact arrangement can be achieved by the two pivot bearings being arranged in the manner of a cardan joint.

According to a further preferred refinement, the arrangement is designed in a structurally more simple and particularly compact manner by the bearing arrangement 3*a* being equipped with a ball/ball socket bearing. This is provided in this way in all the exemplary embodiments which are illustrated in the drawing. In this case, a ball socket 3*d* and a ball 3*e* which engages with the ball socket 3*d* are associated with the bearing arrangement 3*a*. Here and preferably, the ball 3*e* is arranged at one end of the functional element 3, while the ball socket 3*d* is formed in a stationary manner, preferably arranged on a housing of the motor vehicle lock.

In addition to a pivoting movement, the adjustability of the functional element 3 can, in principle, also involve a linear movement. To this end, provision is preferably made for the bearing arrangement 3*a* to have a linear guide, in particular for the vertical adjustment.

The bearing arrangement 3*a* is not a constituent part of the functional element 3 in any of the exemplary embodiments. The bearing function of the bearing arrangement 3*a* is not attributed to resilience of the functional element 3. Against this background, the bearing arrangement 3*a* is an independent component.

Furthermore, provision is preferably made for the bearing function of the bearing arrangement 3*a* to not be attributed to a component which, in respect of its basic shape, corresponds to the basic shape of the functional element 3. If, for example, the functional element 3 is designed in the form of a wire or strip, the bearing function of the bearing arrangement 3*a* still is not attributed to a spring or the like which is bent out of a wire or strip. This emphasizes the independence of the bearing arrangement 3*a*.

Provision is preferably made, very generally, for the bearing function of the bearing arrangement 3*a* to not be attributed to the resilience of a resilient wire or strip.

A variety of options are feasible for shaping the functional element 3. However, in a preferred refinement, the functional element 3 has an elongate shape. In this case, the functional element 3 is preferably designed in an inflexible, further preferably non-resilient, and in particular rigid, manner.

A particularly compact design can be achieved by the functional element 3 being designed in the form of a rod or in the form of a wire.

The functional element 3 preferably has a circular cross section. However, it may also be advantageous, in particular in terms of production, for the functional element 3 to be designed in the form of a tape or strip since elements of this kind can be attached in a simple manner.

In the illustrated, and in this respect preferred, exemplary embodiments, the functional element 3 is designed to be straight in sections. However, depending on the application, it may also be advantageous for the functional element 3 to be matched to the structural conditions and deviate considerably from a straight design.

Depending on the mechanical loading on the functional element 3, it may be advantageous for the functional element 3 to be composed of a metal material or a plastic material.

The lock mechanism 2 has, as is known per se, a pivotable external operating lever 4 and possibly a pivotable internal operating lever 5. It is now essential for the lock mechanism 2 to be able to be moved into the corresponding functional states, preferably into the "unlocked" and "locked" functional states, further preferably into the "anti-theft locked" functional state, further preferably into the "child-safety locked" functional state, by means of a vertical adjustment of the functional element 3. Furthermore, a plurality of functional elements 3 can, in principle, be provided in order to set the abovementioned functional states.

In order to realize functional states of the lock mechanism 2, the functional element 3 preferably provides a switchable coupling between adjustment elements 1, 4, 5 of the lock mechanism 2. Here and preferably, said switchable coupling is a coupling between the adjustment elements pawl 1 on one hand and external operating lever 4 and/or internal operating lever 5 on the other. FIGS. 1 to 3 show a preferred variant without an internal operating lever 5, this possibly being advantageous in certain applications.

In a particularly preferred refinement, provision is made for the functional element 3 to be moved, or for it to be possible for said functional element 3 to be moved, directly into engagement with the above adjustment elements 1, 4, 5 and to couple the adjustment elements 1, 4, 5 in a first functional position (FIGS. 1, 4). In a second functional position, the functional element 3 is disengaged from at least one adjustment element 1, 4, 5 and accordingly decouples the adjustment elements 1, 4, 5. Engagement in the above manner may, as in this case, be direct engagement or else indirect engagement via an intermediate lever or the like. As explained further above, the functional element 3 serves, here and preferably, as a functional element for transmitting the coupling force. In this case, the force which can be transmitted via the functional element 3 preferably acts perpendicular to the longitudinal extent of the functional element 3. In the case of the functional element 3 being designed in the form of a rod or wire, the coupling force preferably acts perpendicular to the respective rod- or wire-like section of the functional element 3.

Given a corresponding functional state of the lock mechanism 2, which is illustrated in FIGS. 1 and 4, operation of the external operating lever 4 and/or of the internal operating lever 5, which is present only in the exemplary embodiment in FIG. 4, by the above coupling action of the functional element 3 causes the pawl 1 to be lifted. The drawing and the following detailed embodiments show that lifting of the pawl 1 is accompanied by a lateral adjustment of the functional element 3 in this case.

In a particularly preferred refinement, provision is made, for this purpose, for the functional element 3 to be oriented substantially radially in respect of the pivot axis of the pawl 1. This means that the functional element 3 extends correspondingly radially. In the illustrated, and in this respect preferred, exemplary embodiments, the functional element 3 also extends substantially along the pawl 1. In principle, this radial orientation can also be related to one of the pivot axes of the external operating lever 4 or of the internal operating lever 5 which may be present. However, this makes no difference in this case since the pawl 1, the external operating lever 4 and the internal operating lever 5 can be pivoted on the same pivot axis. A high level of compactness can be achieved with an arrangement of this kind. In this context, the pivot axis may be the physical pivot shaft or else only the geometric pivot axis.

In order to realize the coupling between the external operating lever 4 and the pawl 1 as discussed above, provision is preferably made for the pawl 1 or a lever which is coupled to the pawl 1 to have a pawl driver contour 6, with the external operating lever 4 or a lever which is coupled to the external operating lever 4 further preferably having an external operating driver contour 7. In this case, the arrangement in the illustrated exemplary embodiments is such that, when the functional element is in the "unlocked" functional position, the external operating lever 4 is coupled to the pawl 1 by means of the external operating driver contour 7, the functional element 3 and the pawl driver contour 6. This functional position is shown most clearly in FIGS. 1 and 4.

Furthermore, provision is preferably made, in the "locked" functional state, for the functional element 3 to be disengaged from the pawl driver contour 6 and from the external operating driver contour 7, so that the external operating lever 4 is decoupled from the pawl 1. The "locked" functional position is illustrated by dashed lines in FIG. 2.

It would also be sufficient for the functional element to be disengaged from one of the two above driver contours 6, 7 in order to realize the "locked" functional position.

The illustration in FIG. 1 shows that pivoting the external operating lever 4 to the left as viewed from above leads to the external operating driver contour 7 engaging with the functional element 3 and exerting a force on the functional element 3 at the engagement point, perpendicular to the longitudinal extent of the functional element 3. This leads to the functional element 3 acting on the pawl driver contour 6, so that the pawl 1 is adjusted, in this case lifted.

A variety of advantageous options are feasible for designing the driver contours 6, 7. Here and preferably, the pawl driver contour 6 is composed of two bearing blocks 6*a*, 6*b*, between which the external operating driver contour 7 runs through in the "locked" functional position. This has the advantage that the functional element 3 is supported optimally at the engagement point at which the operating force is transmitted.

Another preferred variant makes provision for the pawl driver contour 6 to have only a slot into which the external operating driver contour 7 runs in the "locked" functional position. The slot is blocked by the functional element 3 in the "unlocked" functional position.

It should be noted that the two driver contours 6, 7 are readily interchangeable. This means that the described bearing blocks 6*a*, 6*b* or the described slot can also be arranged on the external operating lever 4.

In the further preferred refinement according to FIGS. 4 and 5, an internal operating lever 5 is provided in addition to the external operating lever 4. Accordingly, provision is additionally preferably made for the internal operating lever 5 or a lever which is coupled to the internal operating lever 5 to have an internal operating driver contour 8. Here, when the functional element 3 is in the "unlocked" functional position, the internal operating lever 5 is coupled to the pawl 1 by means of the internal operating driver contour 8, the functional element 3 and the pawl driver contour 6. Therefore, the pawl 1 can also be lifted by means of the internal operating lever 5. Furthermore, provision is accordingly made here for the functional element 3 to be disengaged from the pawl driver contour 6 and from the internal operating driver contour 8, and therefore for the internal operating lever 5 to be decoupled from the pawl 1, in the "locked" functional state. In this case too, provision may be made for the functional element 3 to be disengaged only from one of the two driver contours 6, 8.

Since, in the "locked" functional position, operation of the internal operating lever 5 must nevertheless lead to the pawl 1 being lifted, provision is made, here and preferably, for operation of the internal operating lever 5 to cause the lock mechanism 2 to be moved from the "locked" functional state to the "unlocked" functional state. Details relating to the way in which this unlocking process proceeds will be explained in more detail further below.

In the first instance, it is essential here, with regard to the operation of the internal operating lever 5, for initial free travel to be provided and for the unlocking process to take place when said free travel is complete. The free travel is preferably realized such that the internal operating driver contour 8 is spaced apart from the functional element 3 by a free travel spacing 9 in the unoperated state.

In the preferred embodiment with free travel, pivoting of the internal operating lever 5 firstly causes unlocking (in any desired manner which is not illustrated in FIGS. 1 to 5) in the "locked" functional position, as a result of which the functional element 3 falls from the deflected position into the position which is illustrated in FIG. 4. As the internal operating lever 5 is pivoted further, the pawl 1 is lifted.

However, provision may also be made, in principle, for twofold pivoting of the internal operating lever 5 to be necessary in the "locked" functional position. This is generally referred to as a "double-stroke taxi function". This variant is also easy to realize. When the internal operating lever 5 is first pivoted, the functional element 3 could fall specifically onto the shoulder 8*a*, which is shown in FIGS. 4, 5, of the internal operating driver contour 8. However, the functional element 3 would be held there only until the internal operating lever 5 pivots back, in order to then be pivoted for a second time, this time so as to lift the pawl 1.

A control drive 10 is provided for vertically adjusting the functional element 3 in a controlled manner. It is also possible, in principle, for a plurality of functional elements 3 which are to be adjusted, or other functional elements 3 of conventional design, to be associated with the control drive 10. The associated functional element 3 can accordingly be adjusted into several functional positions by means of the control drive 10. Several functional positions are reached by means of the functional element 3 returning in a resilient manner. Two preferred exemplary embodiments of a control drive 10 according to the proposal are shown in a highly schematic manner in FIGS. 6, 7 and FIGS. 8, 9.

In the two illustrated, and in this respect preferred, exemplary embodiments, the control drive 10 has a control shaft 11 on which the associated functional element 3 is supported, so that the functional element 3 can be deflected in the vertical direction by means of adjusting the control shaft 11. In a particularly preferred refinement, the functional element 3 extends substantially perpendicular to the control shaft axis 12.

The control drive 10 is preferably a motorized control drive 10. The control shaft 11 is then—as illustrated—coupled to a drive motor 13. In this case, the control shaft 11 can be arranged directly on the motor shaft 14 of the drive motor 13. However, it is also feasible for the control shaft 11 to engage with the motor shaft, so as to form a drive connection, via a pinion or the like.

The control drive 10 can also be designed to be manually adjustable. For example, the control drive 10 is then connected to corresponding manual operating elements, such as a locking cylinder or an internal locking button.

The control shaft 11 can be moved—by motor or manually—into the "unlocked" and "locked" control positions. In this case, said control shaft 11 moves the functional element 3 into the "locked" functional position or allows said functional element 3 to return to the "unlocked" functional position.

Here and preferably, the control shaft 11 is designed in the manner of a camshaft, with the associated functional element 3 being supported on the camshaft and it being possible for said associated functional element to be correspondingly deflected by means of an adjustment of the camshaft. This is illustrated in FIG. 7.

In this case, FIG. 7*a*) shows the "unlocked" functional position, which corresponds to the illustrations in FIGS. 1, 4. FIG. 7*b* shows a first adjustment of the control shaft 11, rotated to the left in FIG. 7, without the functional element 3 being adjusted. As a result, the drive motor 13 is subjected to only low loading during starting, this leading to cost-effective design of the drive motor. During further adjustment of the control shaft 11, the cam 11*a* which is arranged on the control shaft 11 deflects the functional element 3 in FIG. 7 upward (FIG. 7*c*)). This corresponds to the "locked" functional position. Said functional position of the functional element 3 is illustrated by dashed lines in FIG. 2. It can be seen by looking at FIGS. 6 and 7 together that the adjustment of the functional element 3 can be realized by means of a control shaft 11 in a structurally particularly simple manner.

A preferred alternative to the design of the control shaft 11 in the manner of a camshaft is for the control shaft 11 to be designed in the manner of a crankshaft. The associated functional element 3 is then accordingly supported on the crankshaft, in particular on the eccentric sections of the crankshaft. Particular advantages in terms of production can be realized by the control shaft 11 being designed in the manner of a bent wire. A particularly compact arrangement is provided if the control shaft 11 is simultaneously the motor shaft 14 of the drive motor 13.

It has already been discussed further above that, in the "locked" functional state, the operation of the internal operating lever 5 leads to an unlocking process. In the exemplary embodiments which are illustrated in FIGS. 6, 7 and 8, 9, and in this respect are preferred, the control shaft 11 is provided, for this purpose, with an override contour 11*b*. A further override contour 5*b* which is arranged on the internal operating lever 5 or on a lever which is coupled to the internal operating lever is associated with said override contour 11*b*, said further override contour 5*b* being illustrated in FIGS. 4 and 5.

In the "locked" functional state (FIG. 7*c*), the internal operating lever-end override contour 5*b* engages with the control shaft-end override contour 11*b* and moves the control shaft 11 into the "unlocked" control position (FIG. 7*a*)) when the internal operating lever 5 is operated. As a result, the functional element 3 is accordingly moved into the "unlocked" functional position and, consequently, the lock mechanism 2 is moved into the "unlocked" functional state. Other variants are feasible for designing this unlocking process.

Positioning of the control shaft 11 is preferably performed in the blocked mode. In the exemplary embodiment which is illustrated in FIGS. 6, 7, the override contour 11*b* runs against a blocking element 15 as the control shaft 11 is adjusted from the "unlocked" control position into the "locked" control position. The control shaft 11 can likewise be returned to the "unlocked" control position in the blocked mode. However, it is also feasible to provide a control-related solution for this purpose. A further blocking element is not provided here and preferably.

The exemplary embodiment which is illustrated in FIGS. 8, 9 corresponds to the exemplary embodiment which is illustrated in FIGS. 6, 7 and has been extended to realize the "anti-theft locked" functional state. The control shaft 11 can accordingly be moved into the "anti-theft locked" control position, which initially corresponds to the "locked" position in respect of the adjustment of the functional element 3. However, in the "anti-theft locked" control position, the control shaft is positioned such that the control shaft-end override contour 11*b* is situated outside the movement range 16 of the internal operating-end override contour 5*b*.

FIG. 9 shows the different control positions of this preferred exemplary embodiment. FIG. 9*a*) shows the unlocked state, in which, as already explained, the functional element 3 is not deflected. In contrast, FIG. 9*b*) shows the "locked" control position, in which the functional element 3 is deflected and the control shaft-end override contour 11*b* is situated in the movement range 16 of the internal operating-end override contour 5*b*. FIG. 9*c* shows an intermediate state between the "unlocked" control position and the "anti-theft locked" control position. FIG. 9*d*) shows the "anti-theft locked" control position. Looking at FIGS. 9*b*) and 9*d*) together shows that, here and preferably, the deflection of the functional element 3 into the "locked" and "anti-theft locked" control positions is identical.

What is essential in the "anti-theft locked" control position which is illustrated in FIG. 9*d*) is the fact that the control shaft-end override contour 11*b* is situated outside the movement range 16 of the internal operating-end override contour 5*b*. This ensures that, in the "anti-theft locked" functional state, the pawl 1 cannot be lifted by the internal operating lever 5 either.

The control shaft 11 is controlled at least in part in the blocked mode in the exemplary embodiment illustrated in FIGS. 8, 9 too. This relates to the "locked" and "anti-theft locked" control positions (FIG. 9*b*), 9*d*)) in any case. To this end, the control shaft 11 has a blocking contour 11*c* which can engage with a blocking element 17. Here and preferably, the blocking element 17 is of adjustable design and can be moved into the "locked" blocking position (FIG. 9*b*)) and "anti-theft locked" blocking position (FIG. 9*d*)). A further drive motor 18 is provided for the purpose of adjusting the blocking element 17. However, manual adjustment of the blocking element 17 is, in principle, also possible in this case. The blocking element 17 can be arranged directly on the motor shaft 19 of the drive motor 18. However, it is also feasible, in principle, for the blocking element 17 to be coupled to the drive motor 18, so as to form a drive connection, via a pinion or the like.

Different blocking positions of the control shaft 11 can be realized by means of adjusting the blocking element 17. When the blocking element 17 is in the "locked" blocking position, the control shaft 11 is blocked in the "locked" control position (FIG. 9*b*)). When the blocking element 17 is in the "anti-theft locked" blocking position, the control shaft 11 is blocked in the "anti-theft locked" control position (FIG. 9*d*)). Ultimately, the blocking element 17 performs the function of an anti-theft locking lever, while the drive motor 18 performs the function of an anti-theft locking motor.

In the exemplary embodiment which is illustrated in FIGS. 8, 9, and in this respect is preferred, the control shaft 11 is also equipped with an ejector contour 11*d* which, in the event of manual adjustment of the control shaft 11 from the "anti-theft locked" control position (FIG. 9*d*)) into the "unlocked" control position (FIG. 9*a*)), engages with the blocking element 17 and moves the blocking element 17 into the "locked" blocking position. This is advantageous, for example, in the event of the drive motor 18 (anti-theft locking motor) failing and manual unlocking having to be carried out, for example by means of a locking cylinder.

It should also be noted that, in a preferred refinement, the above-described functional element 3 is coupled to one of the participating adjustment elements 1, 4, 5, preferably to the pawl 1, the external operating lever 4 or the internal operating lever 5, in such a way that the functional element 3 prestresses the respective adjustment element 1, 4, 5. This double use of the functional element 3 has been discussed further above in conjunction with a pawl spring, an external operating lever spring or an internal operating lever spring.

It is likewise feasible to realize the "child-safety locked" functional state with the motor vehicle lock according to the proposal, as shown further below. A preferred variant makes provision for a further functional element 3 which is likewise adjusted by the control drive 10 to be provided.

FIGS. 10 to 13 show a further embodiment of a motor vehicle lock according to the proposal which is, in principle, of similar design to the motor vehicle lock which is illustrated in FIGS. 4 and 5 and in FIGS. 6 to 9. Said illustration also shows the abovementioned lock catch 1*a* which is associated with the pawl 1. Furthermore, a lock mechanism 2 is also provided here, with the lock mechanism 2 having an external operating lever 4 (not illustrated in FIG. 13) and an internal operating lever 5. It is also essential here for a functional element 3 in the above sense to be provided, it being possible for said functional element to be adjusted into different functional positions.

A control drive 10 with a control shaft 11 on which the associated functional element 3 is supported is also provided in the exemplary embodiment which is shown in FIGS. 10 to 13. Furthermore, the control shaft 11 is likewise equipped with an override contour 11*b* in the above sense. Finally, provision is also made here for the control shaft 11 to be moved not only into the "unlocked" and "locked" control positions but also into the "anti-theft locked" control position in which the override contour 11*b* is deactivated to a certain extent. The "anti-theft locked" control position (FIG. 12) is also reached in the blocked mode in this case. In view of these matching features, which merely form a selection, reference may be made entirely to the explanations relating to the exemplary embodiments which are illustrated in FIGS. 4 and 5, and accordingly 6 to 9, with regard to possible variants and advantages.

FIG. 10 shows the "unlocked" functional state, in which the functional element 3 is preferably not deflected. The illustration shows that the external operating lever 4 is coupled to the pawl 1 by means of the external operating driver contour 7 and the internal operating lever 5 is coupled to the pawl 1 by means of the internal operating driver contour 8, and in each case further by means of the functional element 3 and the pawl driver contour 6.

FIGS. 11 and 13 show the "locked" functional state. In this case, the functional element 3 is deflected such that the functional element 3 is disengaged from the external operating driver contour 7 and from the internal operating driver contour 8. Operation of the internal operating lever 5 leads to an adjustment of the functional element 3 into the "unlocked" functional position, as is explained in more detail in conjunction with the override contour 11*b*.

FIG. 12 shows the "anti-theft locked" functional state, which differs from the "locked" functional state, as explained, in that the control shaft-end override contour 11*b* is rotated outside the movement range of the internal operating lever-end override contour 5*b*.

In the case of the exemplary embodiment which is illustrated in FIGS. 10 to 13, one special feature can be seen in the way in which the external operating driver contour 7 and the internal operating driver contour 8 are realized. Provision is specifically made here for the external operating driver contour 7 and the internal operating driver contour 8 to each be designed in the form of a web and to run along a segment of a circle in relation to the pivot axis of the external operating lever 4 and of the internal operating lever 5 respectively. This can be seen particularly clearly in FIG. 13 with regard to the internal operating driver contour 8. Provision is also made, here and preferably, for the external operating driver contour 7 and the internal operating driver contour 8 to run directly next to one another. This leads, overall, to a particularly compact arrangement. It should be noted here that such a design can also be provided only for one of the two driver contours 7, 8.

In all the illustrated, and in this respect preferred, exemplary embodiments, provision is made for the pawl driver contour 6, the external operating driver contour 7 and the internal operating driver contour 8 to extend substantially parallel to the pivot axis of the pawl 1 and of the external operating lever 4 and of the internal operating lever 5 respectively. This can, in principle, also be provided only for one of said driver contours 6, 7, 8. In particular, the heights of the driver contours 6, 7, 8 can differ, as will be shown.

In the case of the exemplary embodiment which is illustrated in FIGS. 10 to 13, a further special feature can be seen in the way in which the override contour 11*b* is realized, said override contour, in the above sense, interacting with an internal operating lever-end override contour 5*b*. Provision is made, here and preferably, for the control shaft-end override contour 11*b* to be designed such that, in the "locked" functional state, the internal operating lever-end override contour 5*b* runs substantially parallel to the control shaft axis 12 and moves the control shaft 11 into the "unlocked" control position when the internal operating lever 5 is operated. In this case, the control shaft-end override contour 11*b* is preferably designed as a run-on bevel which runs along the control shaft axis 12, in particular as a section of a worm contour which is oriented along the control shaft axis 12. The illustration in FIG. 13 shows the state in which the internal operating lever-end override contour 5*b* engages with the control shaft-end override contour 11*b* during operation of the internal operating lever 5.

A further special feature of the exemplary embodiment which is illustrated in FIGS. 10 to 13 involves the design of the cam 11*a* of the control shaft 11. This cam 11*a* is specifically designed such that stable states are in each case set for the control positions "unlocked", "locked" and "anti-theft locked" on account of the prestressing of the functional element 3. The arrangement is designed such that an increased deflection of the functional element 3 has to be "overcome" in each case when the control shaft 11 is adjusted between said control positions. This is realized by the cam 11*a* being equipped with corresponding edges 21, 22. As a result, the prestressing of the functional element 3 together with the design of the cam 11*a* cause the control shaft 11 to be held in the respective control position.

Adjusting the control shaft 11 by motor is also a special feature in the case of the exemplary embodiment which is illustrated in FIGS. 10 to 13. In principle in this case too, the control shaft 11 has a blocking contour 11*c* which can be moved into engagement with a blocking element 17. The control shaft 11 and the blocking element 17 can preferably be adjusted by motor in this case too. Two drive motors (not illustrated) are preferably provided for this purpose, the drive shafts of said drive motors further preferably being oriented along the control shaft axis 12 or parallel to the control shaft axis 12.

The blocking element 17 blocks the control shaft 11 initially in the "locked" control position and, for this purpose, engages with the blocking contour 11*c*. In order to adjust the control shaft 11 into the "anti-theft locked" control position, the blocking element 17 is moved a short distance into a mouth-like recess in the blocking contour 11*c*. The control shaft 11 can then be adjusted in the direction of the "anti-theft locked" control position until the blocking element 17 preferably becomes jammed in the mouth-like recess in the blocking contour 11*c* and blocks the further adjustment of the control shaft 11.

The above design of the blocking contour 11*c* of the control shaft 11 with a mouth-like recess therefore saves an additional stop or the like, which is replaced here by the jamming of the blocking element 17.

The above mouth-like recess also has a further advantage. Specifically, said recess also provides an ejector contour 11*d* as explained in conjunction with the exemplary embodiment which is illustrated in FIGS. 8, 9, said ejector contour 11*d* moving the blocking element 17 into the "locked" blocking position when the control shaft 11 is manually adjusted from the "anti-theft locked" control position (FIG. 12) into the "unlocked" control position (FIG. 10).

The override contour 11*b* is rotated out of the movement range of the internal operating-end override contour 5*b* in the "anti-theft locked" control position in any case. This corresponds substantially to the functional principle of the exemplary embodiments which are illustrated in FIGS. 4 to 9.

The design of the cam 11*a* of the control shaft 11 is finally advantageous inasmuch as it has, at the side, an associated shoulder 23 which prevents the functional element 3 from jumping off the cam 11*a* at the side.

It has already been noted that the motor vehicle lock according to the proposal can readily be equipped with a child-safety locking function. To this end, FIGS. 14 and 15 show selected components of a control drive 10, in particular the control shaft 11 of a motor vehicle lock, which otherwise corresponds to the design which is shown in FIGS. 10 to 13.

The control shaft 11 which is illustrated in FIGS. 14 and 15 also operates, in principle, in the same way as the control shaft 11 which is shown in FIGS. 10 to 13. Accordingly, said control shaft is equipped with a cam 11*a* (only schematically illustrated) for engaging with the functional element 3. An override contour 11*b* and a blocking contour 11*c* in the above sense are provided in principle, but are not illustrated here.

In the exemplary embodiment illustrated in FIGS. 14 and 15, provision is made for the lock mechanism 2 to be moved, in the above sense, in parallel into the "child-safety locked" functional state, and, as a result, for the "unlocked" functional position to change over automatically into the "unlocked/child-safety locked" functional position. This means that an adjustment of the control shaft 11 into the "unlocked" control position does not cause an adjustment of the functional element 3 into the "unlocked" functional position but rather into the "unlocked/child-safety locked" functional position.

In the "unlocked/child-safety locked" functional position, the internal operating lever 5 is decoupled from the pawl 1 and the external operating lever 4 is coupled to the pawl 1. Therefore, measures are taken in the lock mechanism 2 to ensure that, in the "child-safety locked" functional state, an unlocking process automatically causes the functional element 3 to change over into the "unlocked/child-safety locked" functional position. The "unlocked/child-safety locked" functional position is preferably situated between the "unlocked" functional position and the "locked" functional position.

The "unlocked/child-safety locked" functional position of the functional element 3 is schematically illustrated in FIG. 15*c*). Said figure shows that the external operating driver contour 7 and the internal operating driver contour 8 are designed such that, in this functional position, the functional element 3 is disengaged from the internal operating driver contour 8 and the internal operating lever 5 is decoupled from the pawl 1, and that the external operating lever 4 is coupled to the pawl 1 by means of the external operating driver contour 7, the functional element 3 and the pawl driver contour 6. This selective coupling of the two above driver contours 7, 8 is realized by the external operating driver contour 7 having a greater height than the internal operating driver contour 8, as seen in the deflection direction of the functional element 3. This can be seen in the illustration in FIG. 15. The driver contours 6, 7, 8 are not illustrated in FIG. 14.

FIGS. 14 and 15 show a particularly compact realization of the "child-safety locked" functional state. To this end, a further functional element is provided, specifically an independently adjustable child-safety locking element 20 which can be adjusted between a "child-safety locked" position (FIG. 15*c*)) and a "child-safety unlocked" position (FIG. 15*a*), *b*)). This adjustment of the child-safety locking element 20 corresponds to the engagement of the "child-safety locked" and "child-safety unlocked" functional states.

In the "child-safety locked" functional state, the child-safety locking element 20 holds the functional element 3 in the "unlocked/child-safety locked" functional position, which is upstream of the "unlocked" functional position, when the control shaft is adjusted into the "unlocked" control position. This means that, in the "child-safety locked" functional state, the control shaft 11 can be moved into all possible control positions, with the setting of the "unlocked" control position leading to the functional element 3 being held in the upstream "unlocked/child-safety locked" functional position.

When the control shaft 11 is adjusted into the "locked" control position, the functional element 3 is adjusted, in an unchanged manner, into the "locked" functional position if the child-safety locking means is engaged. Operation of the internal operating lever 5 also causes an unlocking process by means of the override contour 11*b*. Here, however, the functional element 3 falls back only into the upstream "unlocked/child-safety locked" functional position, so that the pawl 1 cannot be lifted by means of the internal operating lever 5.

A variety of advantageous variants are feasible for structurally realizing the child-safety locking element 20. In one particularly preferred refinement, provision is made for the child-safety locking element 20 to be designed as a child-safety locking shaft, with the child-safety locking shaft 20 further preferably being oriented along the control shaft axis 12. This is illustrated in FIGS. 14 and 15. This leads to a particularly compact arrangement if the child-safety locking shaft 20 is at least partially integrated in the control shaft 11. Here and preferably, the child-safety locking shaft 20 is even integrated completely in the control shaft 11, with the child-safety locking shaft 20 being arranged in a cutout 24 in the control shaft 11.

For the engagement of the child-safety locking shaft 20 with the functional element 3, it may be advantageous for the child-safety locking shaft 20 to be designed in the manner of a camshaft, specifically in such a way that the associated functional element 3 is supported on the camshaft. However, in the exemplary embodiment which is illustrated in FIGS. 14 and 15, and in this respect is preferred, the child-safety locking shaft 20 is designed in the manner of a crankshaft, and the associated functional element 3 is supported on the crankshaft 20. In this case, the crankshaft 20 has an engagement section 20*a* which can accordingly be moved into engagement with the functional element 3. The child-safety locking shaft 20 is integrally formed, in particular in the form of a bent wire or the like, this being advantageous in terms of production.

The child-safety locking element 20 can, as explained, be moved into the "child-safety locked" position and into the "child-safety unlocked" position. For this purpose, the child-safety locking element 20 has an associated adjustment section 20*b* by means of which the child-safety locking element 20 can be adjusted. For example, said adjustment section 20*b* is coupled to a child-safety locking switch which is accessible from the end of a side door, or to a child-safety locking drive.

Looking at the illustrations in FIG. 15 together, it can also be seen that the child-safety locking element 20, when in the "child-safety unlocked" position, does not influence the adjustment of the functional element 3. The functional element 3 can be moved into the "unlocked" functional position (FIG. 15*a*)), into the "locked" functional position (FIG. 15*b*))

and into the "anti-theft locked" functional position (not illustrated). This is not the case when the "child-safety locked" functional state is set, as shown in FIG. 15*c*). In this case, the control shaft 11 is in the "unlocked" control position. However, the functional element 3 does not reach the "unlocked" functional position, but rather is automatically held in the "unlocked/child-safety locked" functional state by the child-safety locking element 20. The resulting functional behavior has been explained further above.

In all the illustrated exemplary embodiments, the control shaft 11 is preferably produced from a plastic material which has the greatest possible hardness. At the same time, the materials should be selected such that as little friction as possible is produced between the functional element 3 and the control shaft 11.

If the pawl driver contour 6 has two or more bearing blocks 6*a*, 6*b* as discussed above, the heights of the two bearing blocks 6*a*, 6*b* preferably differ, as viewed in the direction of the deflection of the functional element 3. The upper faces of the bearing blocks 6*a*, 6*b* preferably lie in a straight line which is oriented substantially parallel to the fully deflected functional element 3.

Further optimization of the motor vehicle lock according to the proposal involves the control shaft 11 having a further contour which can be associated with a lock nut or the like. An additional contour of this kind can be realized, in principle, with a low level of expenditure and with a high degree of compactness.

One preferred refinement which can be used within the context of emergency operation involves the functional element 3 being situated in the movement range of an emergency operating lever at all times, specifically independently of the functional position of the functional element 3.

A further teaching, which is likewise accorded an independent meaning, claims a motor vehicle lock which, apart from the realization of the adjustability of the functional element 3, is initially constructed in the same way as the motor vehicle locks described above. Reference may be made to the embodiments above in this respect.

According to this further teaching, for which an exemplary embodiment is not illustrated, it is essential for the functional element 3 to be resilient, in particular to be in the form of a resilient flexible wire or strip, at least in sections. Preferred refinements of a functional element 3 of this kind are explained in DE 10 2008 018 500.0 from the same applicant, the content of said document forming part of the subject matter of the present application in this respect.

In addition, the functional element 3 is mounted in a subregion, in particular an end region, of the functional element 3 by means of a bearing arrangement 3*a*, specifically such that the functional element 3 can be adjusted, in relation to the above reference plane R, in the vertical direction or in the lateral direction solely by means of the bearing arrangement 3*a* and accordingly in the lateral direction or in the vertical direction solely by resilient bending of the functional element 3. It should be noted, in this context, in particular, that all the above embodiments which are made into possible refinements of a bearing arrangement 3*a* are equally applicable.

One preferred exemplary embodiment of the further teaching involves a wire-like functional element 3 which is angled at one end, with the angled end being inserted into a hole in the lock housing or the like, this hole being oriented perpendicular to a flat face of the motor vehicle lock. In this case, this hole forms the bearing arrangement 3*a* and allows the functional element 3 to be pivoted laterally. Vertical adjustment can now be achieved by bending the functional element 3 in a resilient manner.

By way of example, provision can be made, as explained above, for the vertical adjustment of the functional element 3 to be associated with corresponding setting of a functional state of the lock mechanism 2 and, in particular, for lifting of the pawl 1 to be accompanied by lateral adjustment of the functional element 3.

The invention claimed is:

1. A motor vehicle lock comprising:

locking elements comprising a lock catch and a pawl; and a lock mechanism comprising a plurality of functional states, a bearing arrangement, and a functional element comprising an end region and an adjustment range, the adjustment range comprising a plurality of functional positions for the functional element respectively corresponding to each of the plurality of functional states, wherein the end region of the functional element is mounted to the bearing arrangement, and wherein a portion of the functional element other than the end region is adjustable up and down, by a member actuated by an actuator, with respect to a reference plane, and is adjustable side to side with respect to the reference plane.

2. The motor vehicle lock as claimed in claim 1, wherein the motor vehicle lock has a flat face, and in that the reference plane is oriented substantially parallel or substantially perpendicular to the flat face.

3. The motor vehicle lock as claimed in claim 1, wherein the functional element is designed in the form of a lever.

4. The motor vehicle lock as claimed in claim 1, wherein the vertical up and down adjustability and/or the side to side adjustability of the functional element are/is attributed to a pivoting movement of the functional element.

5. The motor vehicle lock as claimed in claim 4, wherein at least one of the up and down adjustability and the side to side adjustability is attributed to the pivoting movement of the functional element about a geometric axis intersecting an end region of the functional element.

6. The motor vehicle lock as claimed in claim 1, wherein the bearing arrangement has two bearing elements which engage with one another in a bearing manner.

7. The motor vehicle lock as claimed in claim 1, wherein the bearing arrangement of the functional element has a pivot bearing for the up and down adjustability and/or a pivot bearing for the side to side adjustability.

8. The motor vehicle lock as claimed in claim 1, wherein the bearing arrangement comprises a ball socket and the end region of the functional element comprises a ball which engages with the ball socket.

9. The motor vehicle lock as claimed in claim 1, wherein the bearing arrangement is not a constituent part of the functional element, and/or in that the bearing function of the bearing arrangement is not attributed to a resilience of the functional element.

10. The motor vehicle lock as claimed in claim 1, wherein the bearing function of the bearing arrangement is not attributed to a component which, in respect of its basic shape, corresponds to the basic shape of the functional element.

11. The motor vehicle lock as claimed in claim 1, wherein the bearing function of the bearing arrangement is not provided by a resilience of a resilient wire or strip.

12. The motor vehicle lock as claimed in claim 1, wherein the functional element has an elongate shape and is designed in an inflexible manner.

13. The motor vehicle lock as claimed in claim 1, wherein the functional element is designed in the form of a rod.

14. The motor vehicle lock as claimed in claim 1, wherein the functional element is composed of a metal material or of a plastic material.

15. The motor vehicle lock as claimed in claim 1, wherein the lock mechanism comprises a pivotable external operating lever, wherein the lock mechanism can be moved into at least one of the plurality of functional states, the plurality of functional states including one or more of an "unlocked" functional state, a "locked" functional state, an "anti-theft locked" functional state, and a "child-safety locked" functional state, by an up and/or down adjustment of the functional element.

16. The motor vehicle lock as claimed in claim 15, wherein, given a corresponding functional state, operation of the external operating lever by the coupling action of the functional element causes the pawl to be lifted, wherein that lifting of the pawl is accompanied by a side to side adjustment of the functional element.

17. The motor vehicle lock as claimed in claim 15, wherein the functional element is oriented substantially radially in respect of one of the pivot axes of the external operating lever of the pawl, wherein it is possible for the external operating lever and the pawl to pivot about the same pivot axis.

18. The motor vehicle lock as claimed in claim 15, wherein the pawl or a lever which is coupled to the pawl has a pawl driver contour, wherein the external operating lever or a lever which is coupled to the external operating lever has an external operating driver contour, in that, when the functional element is in the "unlocked" functional position, the external operating lever is coupled to the pawl by means of the external operating driver contour, the functional element and the pawl driver contour, wherein in the "locked" functional state, the functional element is disengaged from the pawl driver contour and/or from the external operating driver contour, and the external operating lever is decoupled from the pawl.

19. The motor vehicle lock as claimed in claim 18, wherein the internal operating lever or a lever which is coupled to the internal operating lever has an internal operating driver contour, in that, when the functional element is in the "unlocked" functional position, the internal operating lever is coupled by means of the internal operating driver contour, the functional element and the pawl driver contour to the pawl, wherein, in the "locked" functional state, the functional element is disengaged from the pawl driver contour and/or from the internal operating driver contour, and the internal operating lever is decoupled from the pawl.

20. The motor vehicle lock as claimed in claim 15, wherein the lock mechanism comprises a pivotable internal operating lever.

21. The motor vehicle lock as claimed in claim 1, wherein the functional element for realizing functional states of the lock mechanism provides a switchable coupling between adjustment elements of the lock mechanism, wherein the switchable coupling is between the pawl on one hand and the external operating lever and/or the internal operating lever on the other, wherein the functional element can be moved directly or indirectly into engagement with the adjustment elements and wherein the functional element couples the adjustment elements in a first functional position, and wherein the functional element is disengaged from at least one adjustment element and decouples the adjustment elements in a second functional position, wherein a force transmitted via the functional element for coupling the adjustment elements acts perpendicular to the longitudinal extent of the functional element.

22. The motor vehicle lock as claimed in claim 1, wherein the actuator comprises a motorized control drive, which control drive has at least one associated functional element, and in that the associated functional element can be adjusted into at least one functional position by the control drive, wherein the control drive has a control shaft on which the associated functional element is supported, such that the functional element can be deflected up and/or down by an adjustment of the control shaft, wherein the functional element, at least at the support point, extends substantially perpendicular to the control shaft axis.

23. The motor vehicle lock as claimed in claim 22, wherein the control shaft can be moved into the "unlocked" and "locked" control positions and the associated functional element then moves into or enables the corresponding functional positions.

24. The motor vehicle lock as claimed in claim 22, wherein the control shaft is designed in the manner of a camshaft, and in that the associated functional element is supported on the camshaft and can be correspondingly deflected by an adjustment of the camshaft.

25. The motor vehicle lock as claimed in claim 22, wherein the control shaft is designed in the manner of a crankshaft, and in that the associated functional element is supported on the crankshaft, wherein the control shaft is designed in the manner of a bent wire, and wherein the control shaft is simultaneously the motor shaft of the drive motor.

26. A motor vehicle lock comprising:

locking elements comprising a lock catch and a pawl; and a lock mechanism configured to be moved into at least one functional state selected from the group consisting of "unlocked", "locked", "anti-theft locked" or "child-safety locked", wherein the lock mechanism comprises a bearing arrangement and a functional element that can be adjusted into at least one functional position corresponding to the at least one functional state;

wherein the functional element is in the form of a resilient flexible wire or strip at least in portions, wherein the functional element comprises an end region that is mounted to the bearing arrangement, wherein a portion of the functional element other than the end region is adjustable up and down, directly by a member actuated by an actuator, with respect to a reference plane, and is adjustable side to side with respect to the reference plane, wherein the bearing arrangement provides one of the up and down adjustability and the side to side adjustability of the portion of the functional element, and wherein resilient bending of the functional element provides the other one of the up and down adjustability and the side to side adjustability of the portion of the functional element.

* * * * *

UNITED STATES PATENT AND TRADEMARK OFFICE

CERTIFICATE OF CORRECTION

PATENT NO. : 9,074,393 B2
APPLICATION NO. : 13/119924
DATED : July 7, 2015
INVENTOR(S) : Simon Brose and Jurgen Zietlow It is certified that error appears in the above-identified patent and that said Letters Patent is hereby corrected as shown below:

In the claims

Claim 4, column 16, line 32, 'vertical' should be omitted.

Signed and Sealed this
Tenth Day of May, 2016

Michelle K. Lee

Michelle K. Lee
*Director of the United States Patent and Trademark Office*